US011673414B2

(12) United States Patent
Osakabe et al.

(10) Patent No.: US 11,673,414 B2
(45) Date of Patent: Jun. 13, 2023

(54) INK-JET RECORDING APPARATUS

(71) Applicant: Brother Kogyo Kabushiki Kaisha, Nagoya (JP)

(72) Inventors: Yoshinori Osakabe, Seto (JP); Tomohisa Higuchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 10 days.

(21) Appl. No.: 17/136,317

(22) Filed: Dec. 29, 2020

(65) Prior Publication Data

US 2021/0221154 A1 Jul. 22, 2021

Related U.S. Application Data

(63) Continuation of application No. 16/445,991, filed on Jun. 19, 2019, now Pat. No. 10,882,345, which is a (Continued)

(30) Foreign Application Priority Data

Dec. 21, 2016 (JP) ..... JP2016-248331

(51) Int. Cl.
*B41J 29/12* (2006.01)
*B41J 25/34* (2006.01)
(Continued)

(52) U.S. Cl.
CPC ..... *B41J 29/12* (2013.01); *B41J 25/34* (2013.01); *B41J 29/02* (2013.01); *B41J 29/13* (2013.01)

(58) Field of Classification Search
CPC ... B41J 29/12; B41J 29/13; B41J 29/02; B41J 25/34
(Continued)

(56) References Cited

U.S. PATENT DOCUMENTS 5,034,758 A 7/1991 Ebersole et al.
5,056,331 A * 10/1991 Lotz ..... A47B 31/02 62/239
(Continued)

FOREIGN PATENT DOCUMENTS

JP S53-042715 U 4/1978
JP H02-162056 A 6/1990
(Continued)

OTHER PUBLICATIONS

Mar. 27, 2018—International Search Report—Intl App PCT/JP2017/045925.
(Continued)

*Primary Examiner* — Matthew Luu
*Assistant Examiner* — Alexander D Shenderov
(74) *Attorney, Agent, or Firm* — Banner & Witcoff, Ltd.

(57) ABSTRACT

There is provided an ink-jet recording apparatus, including: a casing which is box-shaped, and which has an internal space; a recording head arranged in the internal space, and configured to jet ink droplets; a carriage which is movable, and is arranged in the internal space, and on which the recording head is mounted; and a dust-proof portion arranged between a movable space and an exterior of the casing, the movable space being a space, in the internal space, in which the carriage is movable.

9 Claims, 13 Drawing Sheets

Related U.S. Application Data continuation of application No. PCT/JP2017/045925, filed on Dec. 21, 2017.

(51) Int. Cl.
*B41J 29/02* (2006.01)
*B41J 29/13* (2006.01)

(58) Field of Classification Search
USPC ..... 347/37
See application file for complete search history.

(56) References Cited

U.S. PATENT DOCUMENTS

| | | | |
|---|---|---|---|
| 8,764,163 | B2 | 7/2014 | Muraki |
| 2006/0023021 | A1 | 2/2006 | Shimizu |
| 2007/0146450 | A1 | 6/2007 | Domoto et al. |
| 2008/0238988 | A1 | 10/2008 | Sugahara |
| 2013/0063521 | A1* | 3/2013 | Muraki ..... B41J 2/16523 347/36 |
| 2015/0283832 | A1 | 10/2015 | Osakabe et al. |
| 2015/0298459 | A1 | 10/2015 | Yasumoto et al. |
| 2016/0031217 | A1 | 2/2016 | Moriyama et al. |

FOREIGN PATENT DOCUMENTS

| | | | |
|---|---|---|---|
| JP | 2003-278916 | A | 10/2003 |
| JP | 2005-223415 | A | 8/2005 |
| JP | 2013-056504 | A | 3/2013 |
| JP | 2014-198452 | A | 10/2014 |
| WO | 2013/105499 | A1 | 7/2013 |

OTHER PUBLICATIONS

Mar. 27, 2018—(WO) Written Opinion of ISA—Intl App PCT/JP2017/045925.
Oct. 20, 2020—(JP) Notice of Reasons for Refusal—App 2016-248331.

* cited by examiner

INK-JET RECORDING APPARATUS

CROSS REFERENCE TO RELATED APPLICATIONS

This application is a Continuation of U.S. patent application Ser. No. 16/445,991 filed Jun. 19, 2019 which is a Continuation Application off of International Application No. PCT/JP2017/045925 filed on Dec. 21, 2017 which claims priority to Japanese Patent Application No. 2016-248331 filed on Dec. 21, 2016. The contents of the aforementioned applications are incorporated herein by reference in their entirety.

BACKGROUND

Field of the Invention

The present teaching relates to an ink-jet recording apparatus which carries out an image recording on a sheet by jetting ink droplets from a recording head.

Description of the Related Art

An ink-jet recording apparatus which carries out image recording by jetting an ink toward a sheet conveyed at a position inside a casing has heretofore been know. The ink-jet recording apparatus includes a recording head configured to jet ink droplets, and a carriage which is movable and on which the recording head is mounted. When a sheet that is intermittently conveyed in a sub-scanning direction is at halt, the recording head jets ink droplets toward the sheet while the carriage positioned above the sheet moves in a main scanning direction. Accordingly, an image is recorded on the sheet.

SUMMARY

In a case in which, an ink-jet recording apparatus is installed in a dusty environment, there is a possibility that the dust etc. enters into a casing through an opening or a gap formed in the casing of the ink-jet recording apparatus. For instance, a case of an outdoor in which dust is roiling, or a location facing such outdoor, or an outdoor stall without any or almost without any partition such as a window and a door, can be cited as an example. Particularly, in a case of an ink-jet recording apparatus having a movable carriage, an entry of dust etc. into the casing is remarkable due a process described below.

As the carriage moves from a first position to a second position in the main-scanning direction, a pressure directed from the first position to the second position is generated. Moreover, due to the pressure generated, dust etc. is sucked from outside the casing to inside the casing through the opening and the gap. Next, as the carriage moves in the main scanning direction, from the second position to the first position, a pressure directed from the second position to the first position is generated. Due to the pressure generated, the dust that was sucked into the casing is agitated in the casing, and is dispersed over a wide range in the casing. Due to the process described above, a large amount of dust etc. is accumulated inside the casing.

The present teaching has been made in view of the abovementioned problem, and an object of the present teaching is to provide an ink-jet recording apparatus which is capable of suppressing the entry of the dust etc. into the apparatus.

An ink-jet recording apparatus according to the present teaching includes a casing which is box-shaped, and which has an internal space, a recording head which is arranged in the internal space, and which jets ink droplets, a carriage which is movable, and is arranged in the internal space, and on which the recording head is mounted, and a dust-proof portion (dust preventing portion) which is arranged between a movable space which is a space in the internal space, in which the carriage can be positioned, and an exterior of the casing.

A pressure directed from the exterior of the casing toward the internal space is generated by a movement of the carriage. Due to the pressure generated, dust etc. tends to enter into the internal space from the exterior of the casing, through a gap and an opening formed in the casing. However, most of the dust is prevented from entering into the internal space by the dust-proof portion arranged between the movable space and the exterior of the casing. As a result, it is possible to suppress the entry of dust into the internal space of the casing.

The dust-proof portion may be a porous material.

The dust that has entered into the dust-proof portion is required to pass through a plurality of fine pores formed in the dust-proof portion, for entering from the exterior of the casing into the internal space. However, a large amount of dust, without passing through the plurality of fine pores, is prevented from entering by a wall of a porous material between the plurality of fine pores. As a result, it is possible to suppress the entry of dust etc. into the internal space of the casing.

Moreover, the dust-proof portion being a porous material, a movement of air between the exterior of the casing and the internal space is possible. Accordingly, it is possible to suppress a heat released from the motor etc. arranged in the internal space, from being accumulated in the internal space, and a rise in the temperature of the internal space.

The dust-proof portion may include a channel having a labyrinth shape, which makes the movable space and the exterior of the casing communicate.

The dust etc. that has entered into the dust-proof portion is required to pass through a channel having a labyrinth shape formed in the dust-proof portion, for entering into the internal space from the outside of the casing. However, as the pressure generated due to the movement of the carriage weakens, a large amount of dust etc. stops at some midpoint in the channel. Accordingly, it is possible to suppress the entry of the dust etc. into the internal space of the casing.

Moreover, a movement of air between the exterior of the casing and the internal space is possible via the channel in the dust-proof portion. Accordingly, it is possible to suppress the heat released from the motor etc. arranged in the internal space from being accumulated in the internal space, and to suppress the temperature of the internal space from rising.

The carriage may be movable in a first direction, and a second direction which is opposite to the first direction. The dust-proof portion may be arranged at, at least one of a position which is in the first direction of an end portion of the movable space in the first direction, and is a position between the end portion in the first direction and the exterior of the casing, and a position which is in the second direction of an end portion of the movable space in the second direction, and is a position between the end portion in the second direction and the exterior of the casing.

As the carriage moves in the first direction, a pressure directed in the first direction is generated. Due to the pressure directed in the first direction, dust etc. tends to enter from an external space positioned in the second direction of the casing toward the internal space through a gap or an opening formed in the casing. However, the dust etc. is suppressed from entering into the internal space by the dust-proof portion arranged between the exterior of the casing and an end portion in the second direction which is at a position in the second direction of the end portion in the second direction of the movable space.

Similarly, as the carriage moves in the second direction, a pressure directed in the second direction is generated. Due to the pressure directed in the second direction, dust etc. tends to enter into an internal space from the external space positioned in the first direction of the casing through a gap and an opening formed in the casing. However, the entry of the dust etc. into the internal space is suppressed by the dust-proof portion arranged between the exterior of the casing the end portion in the first direction, which is at a position in the first direction of an end portion in the first direction of the movable space.

The casing may include a lower casing which has the internal space, and an upper casing which is arranged above the lower casing. The upper casing may be movable to a first position at which, the upper casing covers the lower casing from above and closes the internal space, and a second position at which the upper casing exposes the internal space.

In a case in which a sheet has jammed in the internal space, by moving the upper casing to the first position, it is possible to take out the sheet easily.

The lower casing may include a top plate which demarcates an upper end of the internal space. An opening may have been formed in the top plate, at an upper side of the carriage. The dust-proof portion may have been arranged to close a gap between the top plate and the upper casing at least at a peripheral edge portion of the opening, in a state of the upper casing positioned at the first position.

Due to a pressure being generated by the movement of the carriage, dust etc. tends to enter into the internal space from an exterior of the lower casing and the upper casing, through the opening and a gap between the upper casing and the top plate. However, due to the dust-proof portion, a large amount of dust cannot reach the opening. Accordingly, it is possible to suppress an entry of the dust etc. into the internal space of the lower casing.

The dust-proof portion may have been installed in the upper casing.

Since the dust-proof portion is installed in the upper casing, it is possible to expose the internal space through the opening when the casing is moved from the first position to the second position. Accordingly, when a sheet etc. has jammed in the internal space, it is possible to take out the sheet through the opening. Whereas, when the upper casing is positioned at the first position, it is possible to suppress an entry of the dust etc. into the internal space.

The carriage may be movable in a first direction, and a second direction which is opposite to the first direction, and the opening may have been formed at an end portion in the first direction, of the internal space.

As the carriage moves in the second direction, a pressure directed in the second direction is generated. Due to the pressure directed in the second direction, dust etc. tends to enter into an internal space of the lower casing from the external space positioned in the first direction of the casing, through the opening or a gap between the upper casing and the top plate. However, the entry of the dust etc. into the internal space through the opening is suppressed by the dust-proof portion closing at least the peripheral edge portion of the opening.

According to the present teaching, it is possible to suppress an entry of dust etc. into the internal space of the casing of the ink-jet recording apparatus.

DESCRIPTION OF THE EMBODIMENTS

Figure 1:
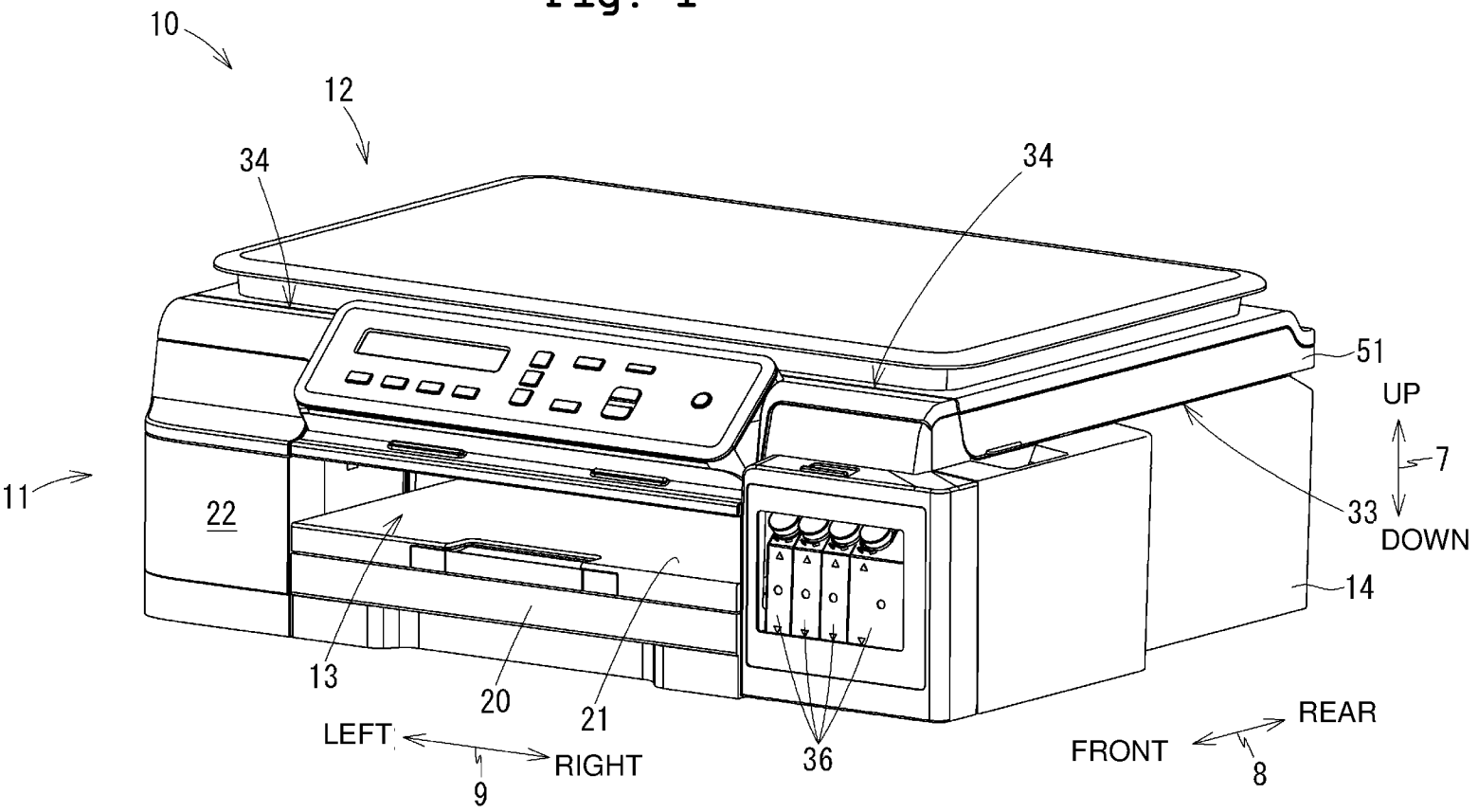
FIG. 1 is a perspective view of a multifunction device 10 in a state in which, a scanner casing 51 is positioned at a first position.

An embodiment of the present teaching will be described below. The embodiment described below is only an example of the present teaching, and it is needless to mention that appropriate changed can be made in the present teaching without departing from the scope of the present teaching. Moreover, in the following description, a vertical direction 7 is defined with reference to a state in which a multifunction device 10 is usably installed, a frontward-rearward direction 8 is defined letting a surface provided with an opening 13 to be a front surface 22, and a leftward-rightward direction 9 is defined upon viewing the multifunction device 10 from a front side. The vertical direction 7, the frontward-rearward direction 8, and the leftward-rightward direction 9 are mutually orthogonal.

<Overall Structure of Multifunction Device 10>

As depicted in FIG. 1, the multifunction device 10 (an example of the ink-jet recording head) is formed to be a substantially thin rectangular parallelepiped.

The multifunction device 10 includes a scanner section 12 at an upper side. The scanner section 12 reads by an image sensor, an image recorded on a document such as a paper and image data acquired. The scanner section 12 is a so-called flat-bed scanner. The flat-bed scanner being known heretofore, a description in detail of the scanner section 12 will be omitted here.

The multifunction device 10 includes a printer section 11 at a lower side. The printer section 11 records an image on a paper 15 (refer to FIG. 2), on the basis of the image data.

The printer section 11 includes a printer casing 14 (an example of the lower-portion casing). The scanner section 12 includes a scanner casing 51 (an example of the upper-portion casing). A casing of the printer section 11 is formed by the printer casing 14 and the scanner casing 51.

The printer casing 14 has a box shape formed to be substantially rectangular parallelepiped. The printer casing 14 includes an internal space 30 (refer to FIG. 2 and FIG. 3). A conveyance path 23 (refer to FIG. 2) that will be described later, is formed in the internal space 30. Moreover, a feeding roller 25, a pair of conveyance rollers 63, a pair of discharge rollers 66, and a recording section 24 that will be described later, are arranged in the internal space 30 as depicted in FIG. 2.

Figure 2:
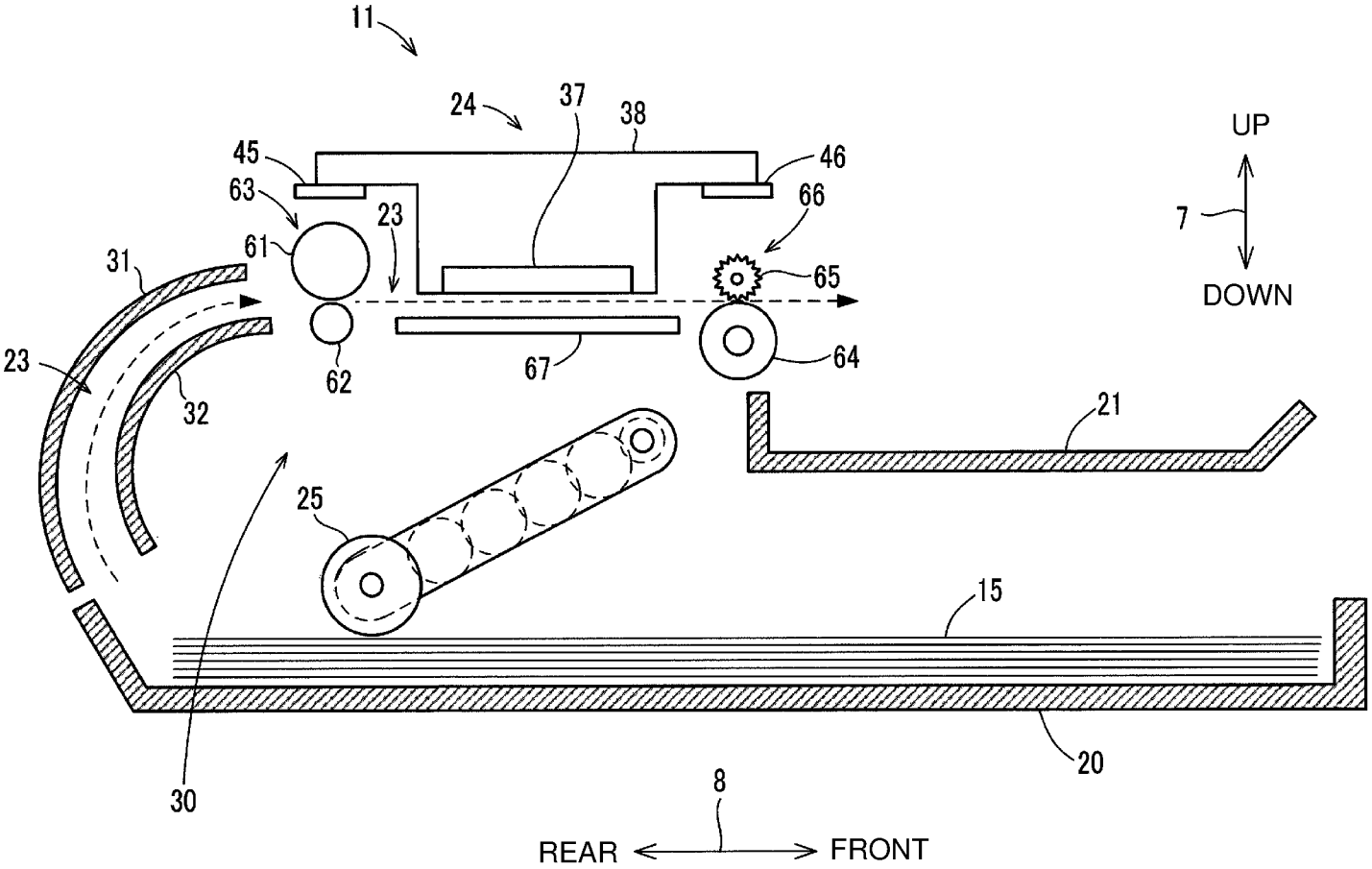
FIG. 2 is a vertical (longitudinal) cross-section depicting schematically an internal structure of a printer section 11.

As depicted in FIG. 2, the printer section 11 includes the conveyance path 23, the feeding roller 25, the pair of conveyance rollers 63, the pair of discharge roller 66, and the recording section 24. The conveyance path 23 is a path through which the paper 15 passes. The feeding roller 25 feeds or supplies the paper 15 supported in the feeding tray 20 to the conveyance path. The feeding roller 25 rotates by a driving force of a feeding motor (not depicted in the diagram) being transmitted. The pair of conveyance rollers 63 and the pair of discharge rollers 66 are arranged in the conveyance path 23. The pair of feeding rollers 63 and the pair of discharge rollers 66 transport the paper 15 fed to the conveyance path 23 by the feeding roller 25. The recording section 24 records an image on the recording paper 15 by an ink-jet recording, on the basis of the image data read from the document by the scanner section 12.

Figure 3:
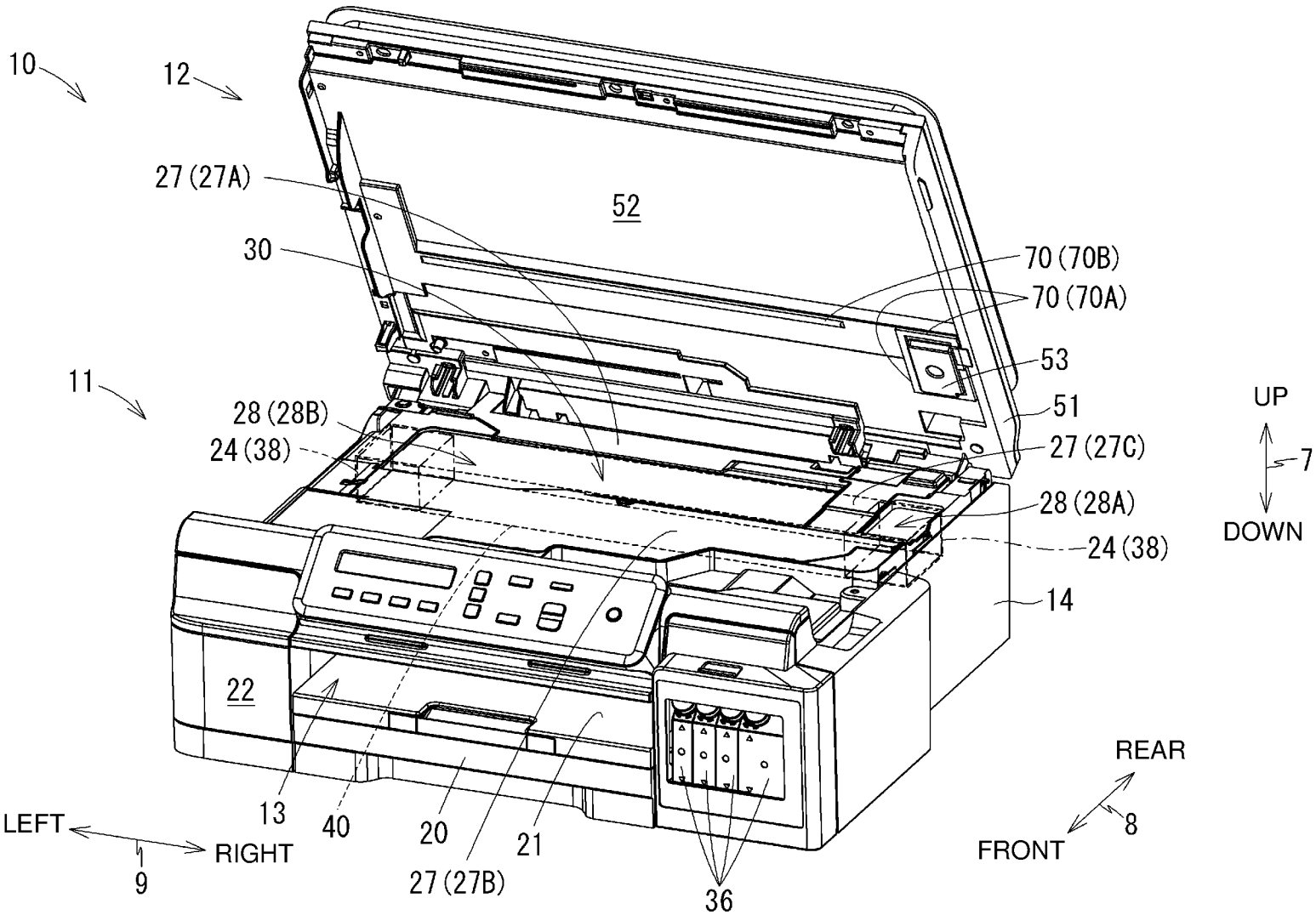
FIG. 3 is a perspective view of the multifunction device 10 in which the scanner casing 51 is positioned at a second position, and dust-proof portions 70A and 70B are installed.

As depicted in FIG. 3, the printer casing 14 includes a top plate 27 at an upper portion thereof. A lower surface of the top plate 27 demarcates an upper end of the internal space 30. An opening 28 extended in the leftward-rightward direction 9 is formed in the top plate 27. The internal space 30 communicates with an exterior of the printer casing 14 (a space above the printer casing 14) through the opening 28.

The top plate 27 includes a rear plate 27A, a front plate 27B, and a bridge plate 27C. The rear plate 27A is positioned at a rear side of the opening 28. The front plate 27B is positioned at a front side of the opening 28. The front plate 27 supports a printed circuit board (not depicted in the diagram). Electronic components such as a CPU (central processing unit) and a memory are mounted on the printed circuit board. An operation of the multifunction device 10 is controlled by a computer program stored in the memory, being executed by the CPU.

The bridge plate 27C connects the rear plate 27A and the front plate 27B. The bridge plate 27C supports electric wires (not depicted in the diagram) which connect electronic components arranged in the scanner section 12 and electronic components arranged on the front plate 27B. The bridge plate 27C divides the opening 28 into an opening 28A on a right side and an opening 28B on a left side. The bridge plate 27C is formed at a right portion of the printer casing 14. Accordingly, a length in the leftward-rightward direction 9 of the opening 28A is shorter than a length in the leftward-rightward direction 9 of the opening 28B.

As depicted in FIG. 1 and FIG. 3, an opening 13 is formed in a front surface 22 of the printer casing 14. The internal space 30 communicates with an exterior (a space at a front side of the printer casing 14) of the printer casing 14 through the opening 13. The feeding tray 20 and the discharge tray 21 can be inserted into and drawn out from the printer casing 14 through the opening 13. In FIG. 1 to FIG. 10, FIG. 12, and FIG. 13, a state in which the feeding tray 20 and the discharge tray 21 are installed in the printer casing is depicted.

The scanner casing 51 is formed to be substantially rectangular parallelepiped. The scanner casing 51 is arranged above the printer casing 14.

A rear-end portion of the scanner casing 51 is connected to a rear-end portion of the printer casing 14 by a hinge. Accordingly, the scanner casing 51 is pivotable to a first position (a position depicted in FIG. 1) and a second position (a position depicted in FIG. 3) with the rear-end portion of the scanner casing 51 (such as the hinge) as an axis. The scanner casing 51 at the first position is inclined with respect to the printer casing 14, and covers the printer casing 14 from above. More elaborately, the scanner casing 51 at the first position covers the top plate 27 of the printer casing 14. The scanner casing 51 at the second position is erect with respect to the printer casing 14, and exposes the top plate 27. More elaborately, the scanner casing 51 at the second position exposes the internal space 30 through the opening 28.

<Conveyance Path 23>

As depicted in FIG. 2, a starting point of the conveyance path 23 is a rear-end portion of the feeding tray 20. The transport path is extended upward from below while making a U-turn, and is extended frontward and passes below the recording section 24 to reach the discharge tray 21. The conveyance path 23 is a space demarcated by a first guide member 31 and a second guide member 32 facing mutually leaving a predetermined distance in between, the pair of conveyance rollers 63, the recording section 24 and a platen 67, which are facing mutually leaving a predetermined distance in between, and the pair of discharge rollers 66. The paper 15 is conveyed through the conveyance path 23 in a conveyance direction depicted by dashed lines in FIG. 2.

<Pair of Conveyance Rollers 63 and Pair of Discharge Rollers 66>

As depicted in FIG. 2, the pair of conveyance rollers 63 is arranged in the conveyance path 23. The pair of conveyance rollers 63 includes a conveyance roller 61 and a pinch roller 62. The pinch roller 62 is in a pressed contact with the conveyance roller 61 by a resilient member such as a spring (not depicted in the diagram). Accordingly, the pair of conveyance rollers 63 is capable of pinching the paper 15.

The pair of discharge rollers 66 is arranged at a downstream side in the conveyance direction, of the pair of conveyance rollers 63 in the conveyance path 23. The pair of discharge rollers 66 includes a discharge roller 64 and a spur 65. The spur 65 is in a pressed contact with the discharge roller 64 by a resilient member such as a spring. Accordingly, the pair of discharge rollers 66 is capable of pinching the paper 15.

The conveyance roller 61 and the discharge roller 64 are driven by a driving force of a conveyance motor (not depicted in the diagram) being transmitted. The conveyance roller 61 to which, the driving force has been transmitted, transports the paper 15 in the conveyance direction while pinching between the pinch roller 62 and the conveyance roller 61. The discharge roller 64 to which, the driving force has been transmitted, transports the paper 15 in the conveyance direction while pinching between the spur 65 and the discharge roller 64.

<Recording Section 24>

As depicted in FIG. 2, the recording section 24 is arranged between the pair of conveyance rollers 63 and the pair of discharge rollers 66 in the conveyance path 23. The recording section 24 includes a recording head 37 which jets ink droplets by an ink-jet method, and a carriage 38 on which the recording head 37 is mounted. The carriage 38 is supported by guide rails 45 and 46, to be capable of moving along the leftward-rightward direction 9 which is orthogonal to the conveyance direction of the paper 15. In other words, the carriage 38 is capable of moving in a rightward direction (an example of the first direction), and a leftward direction (an example of the second direction) which is opposite to the rightward direction. The guide rails 45 and 46 are supported by the printer casing 14. The carriage 38 moves by a driving force of a carriage driving motor (not depicted in the diagram) being transmitted thereto.

The recording head 37 is arranged at a lower portion of the carriage 38. A plurality of nozzles (not depicted in the diagram) is formed in a lower surface of the recording head 37. The nozzles are exposed to a lower surface of the carriage 38. Ink droplets are jetted toward the platen 67 which is at a lower side. The platen 67 is arranged below the recording head 37, to be facing the recording head 37. The platen 67 is in the form of a flat plate by and large, and the paper 15 can be supported on an upper surface thereof.

As depicted in FIG. 1, ink tanks 36 of each color (such as black, yellow, cyan, and magenta) are arranged at a front right portion of the printer section 11. An ink of each color is supplied from the ink tank 36 to the recording head 37. While the carriage 38 moves along the leftward-rightward direction 9, an ink of each color is jetted selectively as micro droplets of ink from each nozzle. Accordingly, an image is recorded on the paper 15 conveyed on the platen 67.

In the present embodiment, as depicted in FIG. 3, the carriage 38 is arranged right below the opening 28 formed in the top plate 27 of the printer casing 14. A position where the carriage 38 is arranged may be shifted to a front side or a rear side of the opening 28.

The carriage 38 is movable from a right side of the conveyance path 23, all along the left side of the conveyance path. As depicted by an alternate long and short dashed line in FIG. 3, when the carriage 38 is at the rightmost position of a range in which the carriage 38 is capable of moving, the carriage 38 is positioned right below the opening 28A. AS depicted by an alternate long and two short dash line, when the carriage 38 is at the leftmost position of the range in which the carriage 38 is capable of moving, the carriage is positioned right below a left-end portion of the opening 28B. The carriage 38 is capable of moving between the position depicted by the alternate long and short dashed line in FIG. 3 and the alternate long and two short dash line in FIG. 3. In other words, a space indicated by dashed lines in FIG. 3 is a movable space 40 in which the carriage 38 is capable of moving. The movable space 40 in the internal space 30 is a space in which the carriage 38 can be positioned. The opening 28*a* is formed at a right-end portion of the movable space 40, in the leftward-rightward direction 9. The opening 28B is formed at a portion of the movable space 40, other than a right-end portion.

<Dust-Proof Portion 70>

The dust-proof portion 70 is a portion for preventing an entry of dust etc. into the internal space 30 from an exterior of the casing (printer casing 14 and the scanner casing 51). The dust-proof portion 70 is a porous material such as foamed polyurethane. The dust-proof portion 70 is arranged between the exterior of the casing of the multifunction device 10 and the internal space 30.

In the present embodiment, as depicted in FIG. 3, the dust-proof portion 70 is installed at two locations of the scanner casing 51 as will be described below in detail. In other words, the dust-proof portion 70 includes a dust-proof portion 70A and a dust-proof portion 70B. The dust-proof portion 70 is installed by a heretofore known means such as by adhering and fitting.

A projecting portion (projection) 53 is formed on a lower surface 52 of the scanner casing 51. The projecting portion 53 is formed at a position facing the opening 28A formed in the top plate 27 of the printer casing 14. When the scanner casing 51 is at the first position, the projecting portion 53 is set in down below the opening 28A through the opening 28A. The dust-proof portion 70A is arranged at a peripheral edge of the projecting portion 53, to enclose or surround the projecting portion 53 on the lower surface 52 of the scanner casing 51. In a state in which the scanner casing 51 is positioned at the first position, the dust-proof portion 70*a* fills in a gap formed between the opening 28A and the projecting portion 53, at the peripheral edge portion of the opening 28A. In other words, in the state in which the scanner casing 51 is positioned at the first position, the dust-proof portion 70A, at the peripheral edge portion of the opening 28A, is arranged to close a gap between the lower surface 52 of the scanner casing 51 and the top plate 27 of the printer casing 14.

Accordingly, dust entered from an exterior of the multifunction device 10 into a space between the lower surface 52 of the scanner casing 51 and the top plate 27 of the printer casing 14 through a gap 33 (refer to FIG. 1) between the scanner casing 51 and the printer casing 14 can be suppressed from entering into the internal space 30 through the opening 28A.

The dust-proof portion 70B is arranged on the lower surface 52 of the scanner casing 51. The dust-proof portion 70B is arranged on a left side of the dust-proof portion 70A. The dust-proof portion 70B is extended in the leftward-rightward direction 9. When the scanner casing 51 is at the first position, the dust-proof portion 70B is positioned near a front end of the opening 28B. Moreover, in a state of the scanner casing 51 positioned at the first position, a right end of the dust-proof portion 70B is positioned near a right end of the opening 28B, and a left end of the dust-proof portion 70B is positioned near a left end of the opening 28B.

Accordingly, in the state of the scanner casing 51 positioned at the first position, the dust-proof portion 70B, near the front end of the opening 28B, closes a gap between the lower surface 52 of the scanner casing 51 and the top plate 27 of the printer casing 14. As a result, it is possible to reduce dust at front side of the opening 28B in a space between the lower surface and the top plate 27 entering into the internal space 30 through the opening 28B from the front side of the opening 28B.

Effect of Embodiment

A pressure directed from an outside of the casing toward the internal space 30 is generated by the movement of the carriage 38. Due to the pressure generated, dust tends to enter into the internal space through the opening 28 and the gap 33 formed in the casing. However, a large amount of dust is prevented from entering into the internal space 30 by the dust-proof portion 70 arranged between the movable space 40 and the exterior of the casing. As a result, it is possible to suppress the entry of dust into the internal space 30 of the casing.

Moreover, the dust that has entered into the dust-proof portion 70 is required to pass through a plurality of fine pores formed in the dust-proof portion 70 which is a porous material, for entering from the exterior of the casing into the internal space 30. A large amount of dust, without passing through the plurality of fine pores, is prevented from entering by a wall of a porous material between the plurality of fine pores. As a result, it is possible to suppress the entry of dust etc. into the internal space 30 of the casing.

Moreover, the dust-proof portion 70 being a porous material, a movement of air between the exterior of the casing and the internal space 30 is possible. Accordingly, it is possible to suppress heat released from a motor etc. arranged in the internal space 30 from being accumulated in the internal space 30, and a rise in the temperature of the internal space 30.

Moreover, when the paper 15 has jammed in the internal space 30, it is possible to take out the paper 15 easily by moving the scanner casing 51 toward the second position.

Furthermore, by the pressure being generated by the movement of the carriage 38, dust etc. tends to enter from the exterior of the printer casing 14 and the scanner casing 51 into the internal space 30 through the opening 28A and the gap between the lower surface of the scanner casing 51 and the top plate 27 of the printer casing 14 through the opening 28A. However, a large amount of dust cannot reach the opening 28A because of the dust-proof portion 70A. Accordingly, it is possible to suppress the entry of dust etc. into the internal space 30 of the printer casing 14.

As the carriage 38 is moved to left, a pressure in the leftward direction is generated. Due to the pressure in the leftward direction, the dust etc. tends to enter toward the internal space 30 of the printer casing 14 through the opening 28A and the gap between the scanner casing 51 and the top plate 27, from an external space positioned on right side of the casing. However, the entry of the dust into the internal space 30 through the opening 28A is suppressed by the dust-proof portion 70A which closes at least the peripheral edge portion 28A.

Modified Embodiment

In the embodiment described above, the dust-proof portion 70 was installed at two locations of the lower surface 52 of the scanner casing 51. More elaborately, the dust-proof portion 70A is installed at the position corresponding to the peripheral edge portion of the opening 28A, and the dust-proof portion 70B is installed at the position corresponding to the vicinity of the front end of the opening 28A. However, the number of dust-proof portions 70 to be installed is not restricted to two. The number of dust-proof portions 70 to be installed may be arbitrary. Moreover, positions for installing the dust-proof portion 70 are not restricted to the above-mentioned positions.

Figure 4:
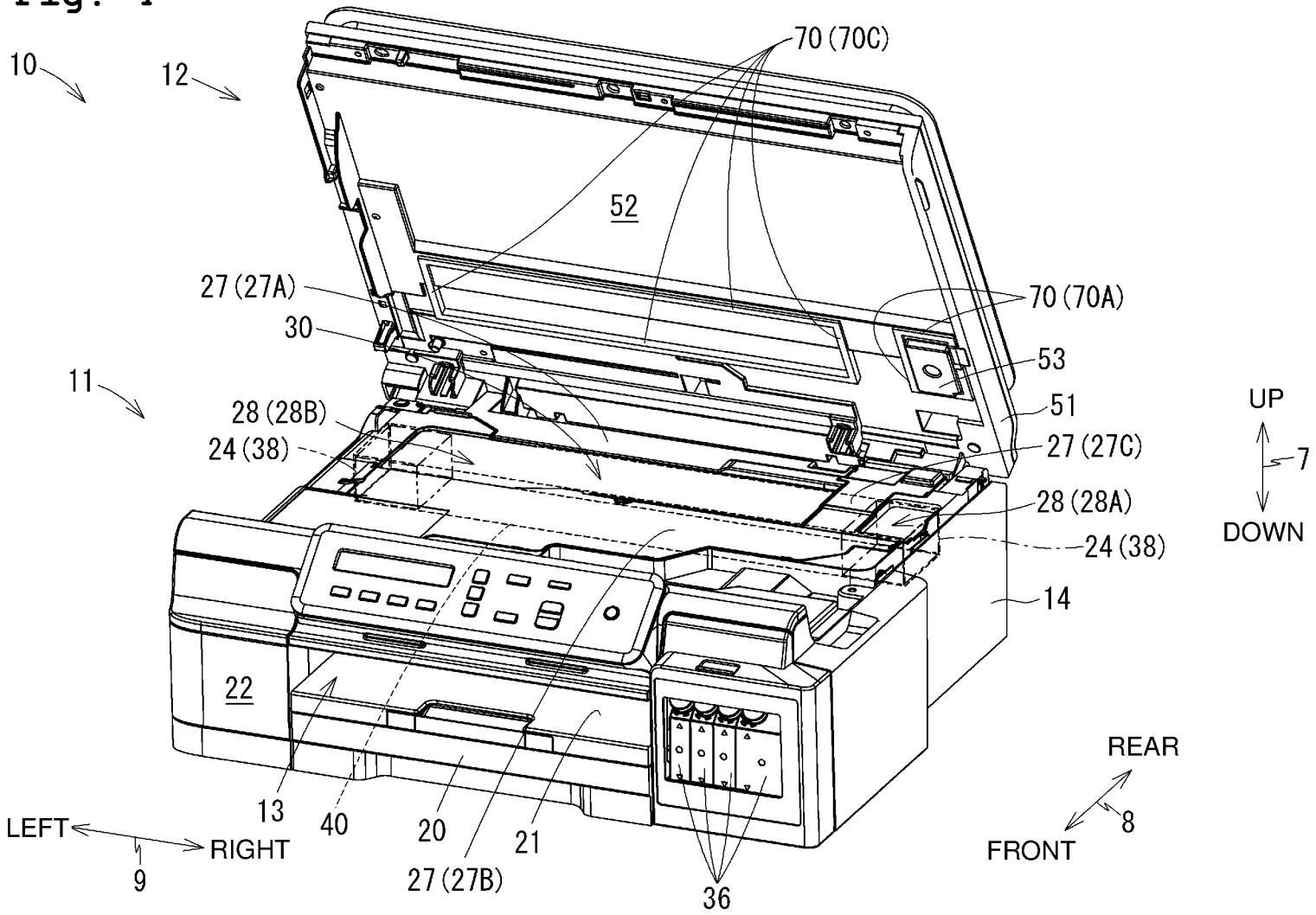
FIG. 4 is a perspective view of the multifunction device 10 in which the scanner casing 51 is positioned at the second position, and the dust-proof portion 70A and a dust-proof portion 70C are installed.

For instance, as depicted in FIG. 4, a dust-proof portion 70C may have been installed at a position corresponding to the peripheral edge portion of the opening 28B in the lower surface 52 of the scanner casing 51. In FIG. 4, the dust-proof portion 70 includes the dust-proof portion 70A and the dust-proof portion 70C. The dust-proof portion 70C is arranged to close the gap between the lower surface 52 of the scanner casing 51 and the top plate 27 of the printer casing 14, at the peripheral edge portion of the opening 28B in a state of the scanner casing 51 positioned at the first position. Accordingly, it is possible to reduce the dust that has entered into a space between the lower surface 52 of the scanner casing 51 and the top plate 27 of the printer casing 14, entering into the internal space 30 through the opening 28B.

Figure 5:
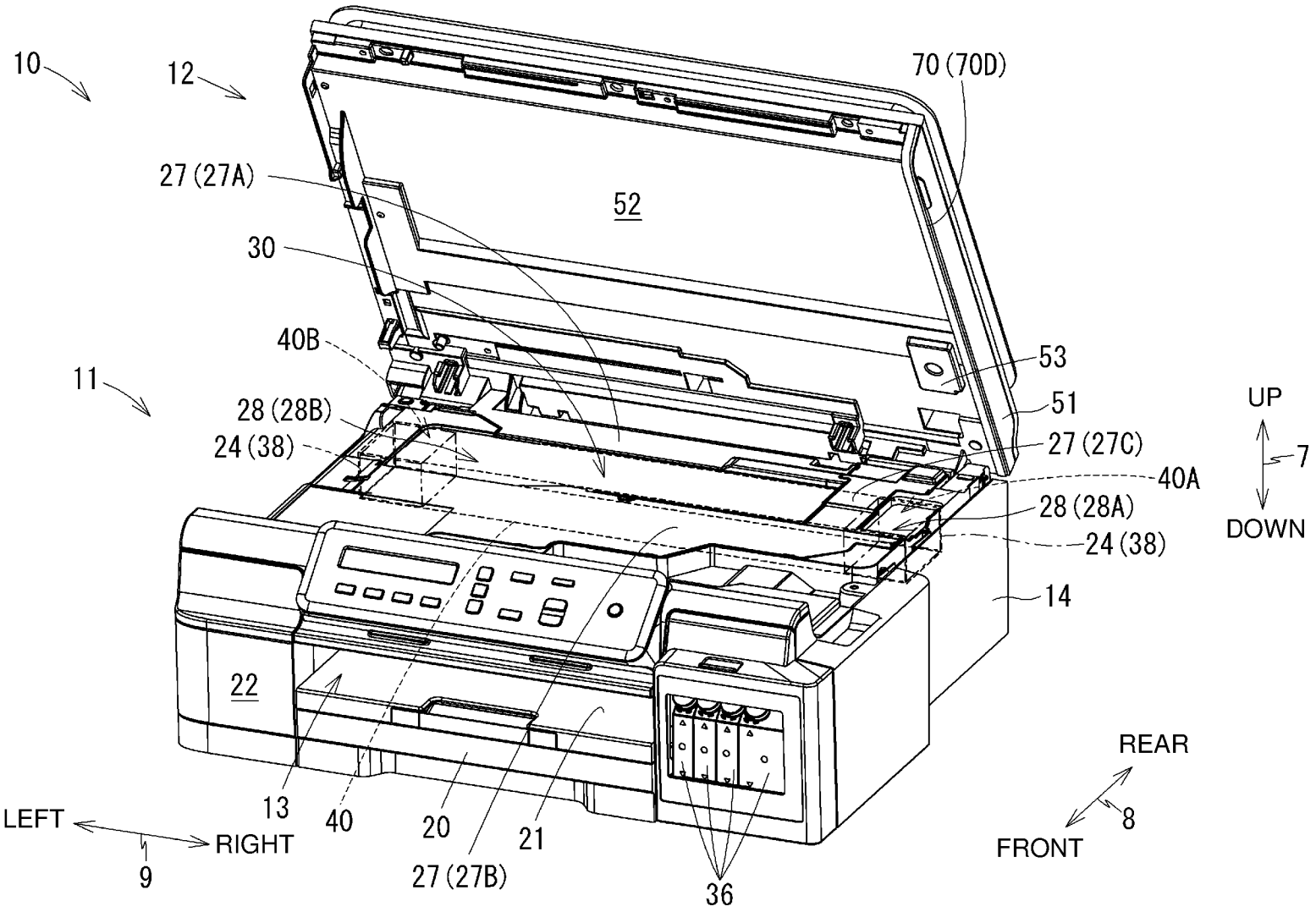
FIG. 5 is a perspective view of the multifunction device 10 in which the scanner casing 51 is positioned at the second position, and a dust-proof portion 70D is installed.

Moreover, as depicted in FIG. 5, a dust-proof portion 70D may have been installed at a right-end portion of the lower surface 52 of the scanner casing 51. The dust-proof portion 70D is extended approximately in the frontward-rearward direction 8 along the lower surface 52 of the scanner casing 51. The dust-proof portion 70D closes the gap 33 (refer to FIG. 1) between the right-end portion of the lower surface 52 of the scanner casing 51 and a right-end portion of the top plate 27 of the printer casing 14 in a state of the scanner casing 51 positioned at the first position. Accordingly, it is possible to reduce the dust etc. entering into the space between the lower surface 52 of the scanner casing 51 and the top plate 27 of the printer casing 14 from the outside of the multifunction device 10. In FIG. 5, although only the dust-proof portion 70D has been installed on the scanner casing 51, at least one of the dust-proof portions 70A, 70B, and 70C may have been provided in addition to the dust-proof portion 70D.

Moreover, the dust-proof portion 70 may have been installed at a left-end portion of the lower surface 52 of the scanner casing 51, instead of the dust-proof portion 70D, or, in addition to the dust-free portion 70D.

The dust-proof portion 70 may have been installed at, at least one of a position on a right side of the right-end portion 40A of the movable space 40, which is a position (where the dust-proof portion 70D has been installed) between the right-end portion 40A and the exterior of the casing (the printer casing 14 and the scanner casing 51), or a position on a left side of a left-end portion 40B of the movable space 40, which is a position between the left-end portion 40B and the exterior of the casing (position of the dust-proof portion 70 installed at a left-end portion of the lower surface 52 of the scanner casing 51).

As the carriage 38 moves toward the right side, a pressure directed rightward is generated. Due to the pressure directed rightward, dust etc. tends to enter from an external space positioned at a left side of the casing toward the internal space 30 of the casing through the gap or the opening 28 formed in the casing. However, the entry of the dust into the internal space 30 is suppressed by the dust-proof portion 70 arranged at the position on the left side of the left-end portion 40B of the movable space 40, which is a position between the left-end portion 40B and the exterior of the casing.

Similarly, as the carriage 38 moves toward the left side, a pressure directed leftward is generated. Due to the pressure directed leftward, dust etc. tends to enter from an external space positioned at a right side of the casing toward the internal space 30 of the casing through the gap 33 or the opening 28 formed in the casing. However, the entry of the dust into the internal space 30 is suppressed by the dust-proof portion 70D arranged at the position on the right side of the right-end portion 40A of the movable space 40, which is a position between the right-end portion 40A and the exterior of the casing.

Figure 6:
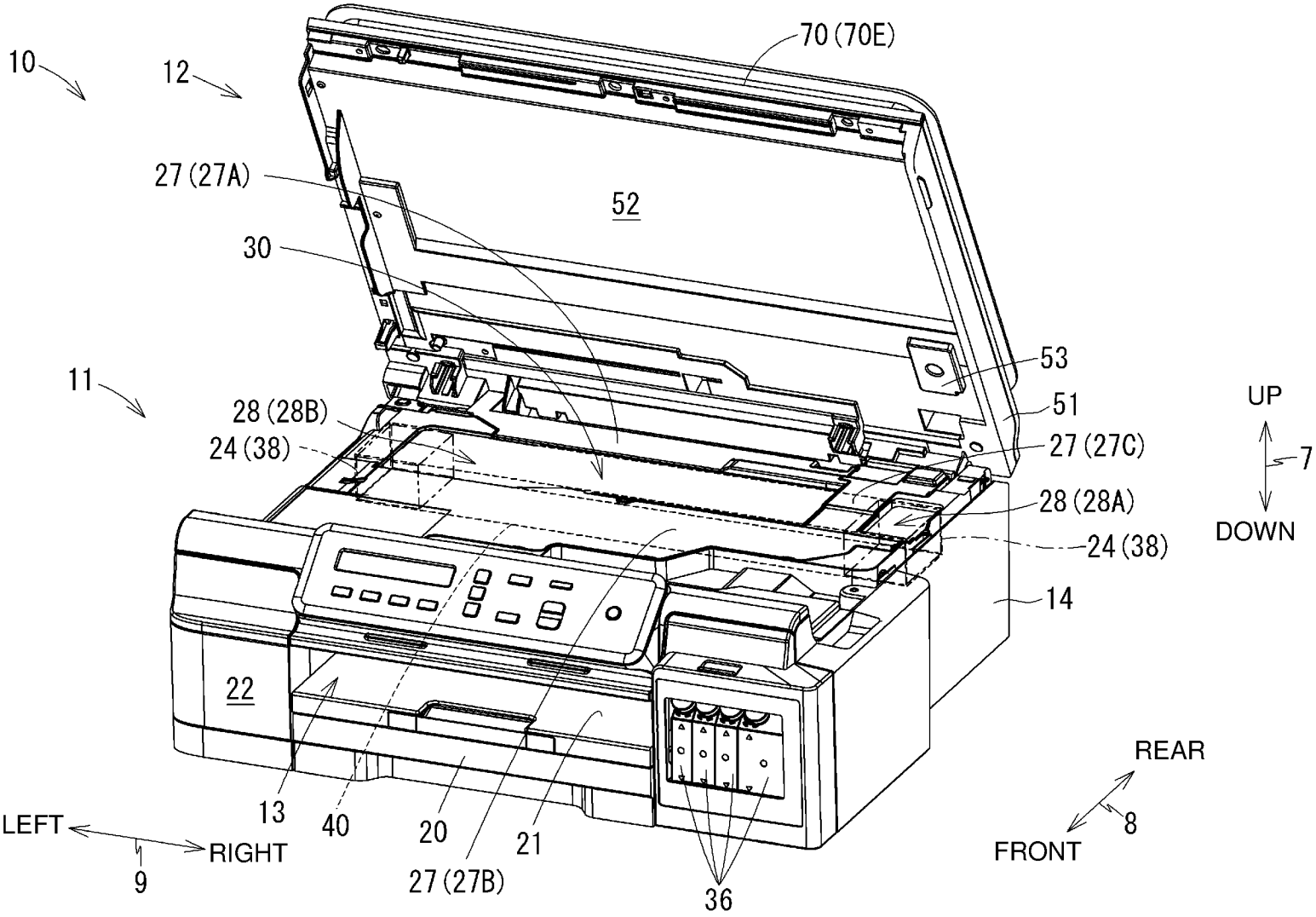
FIG. 6 is a perspective view of the multifunction device 10 in which the scanner casing 51 is positioned at the second position, and a dust-proof portion 70E is installed.

Moreover, for instance, as depicted in FIG. 6, a dust-proof portion 70E may have been installed on a front surface of the scanner casing 51. The dust-proof portion 70E is extended approximately in the leftward-rightward direction 9 along the front surface of the scanner casing 51. The dust-proof portion 70E closes a gap 34 (refer to FIG. 1) between the front surface of the scanner casing 51 and the printer casing 14, in a state of the scanner casing 51 positioned at the first position. Accordingly, it is possible to reduce the dust etc. entering into a space between the lower surface 52 of the scanner casing 51 and the top plate 27 of the printer casing 14 from the exterior of the multifunction device 10. In FIG. 6, although only the dust-proof portion 70E has been installed on the scanner casing 51, at least one of the dust-proof portions 70A, 70B, 70C, and 70D may have been installed in addition to the dust-proof portion 70E.

Figure 7:
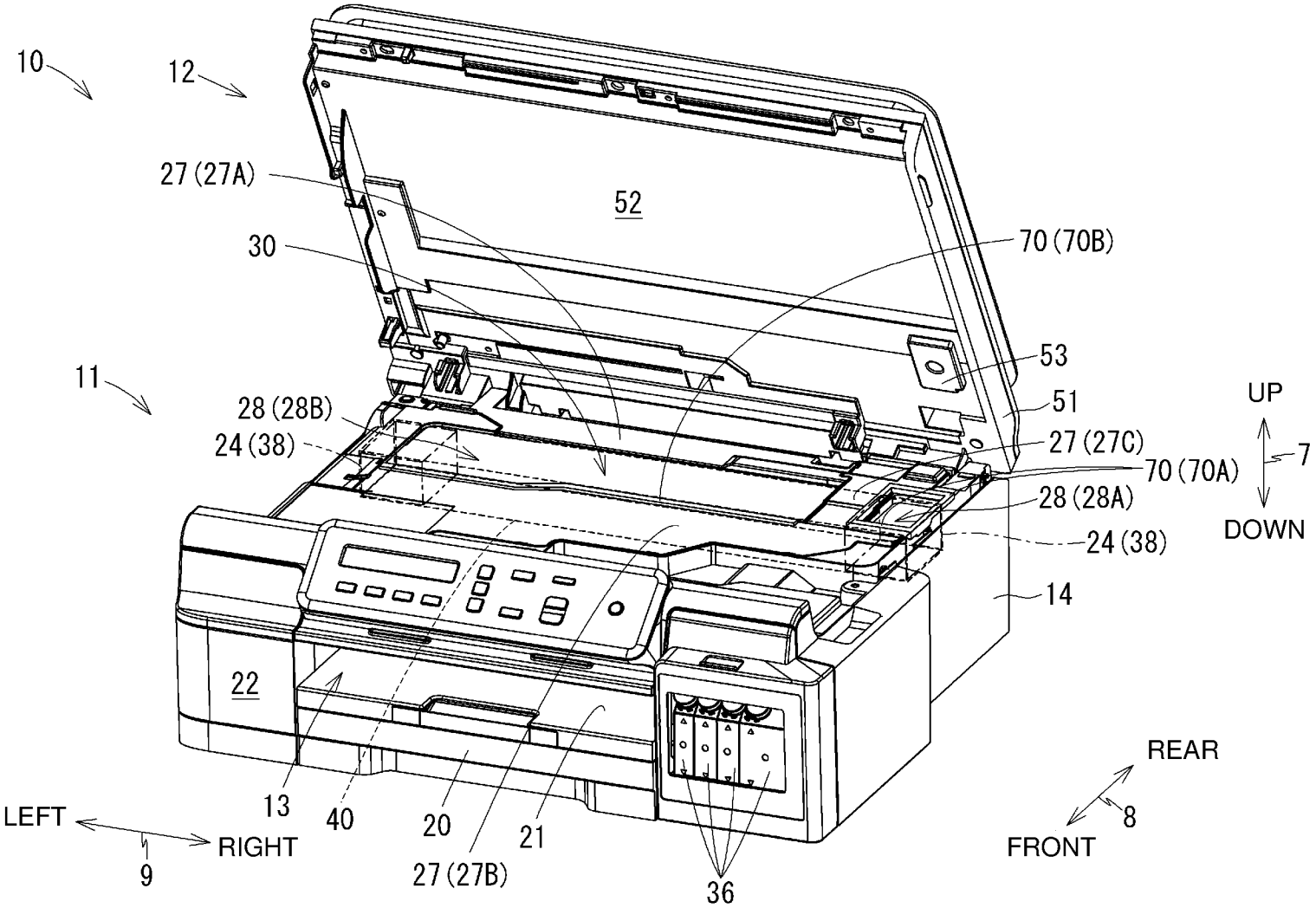
FIG. 7 is a perspective view of the multifunction device 10 in which the scanner casing 51 is positioned at the second position, and the dust-proof portions 70A and 70B are installed in a printer casing 14.
Figure 8:
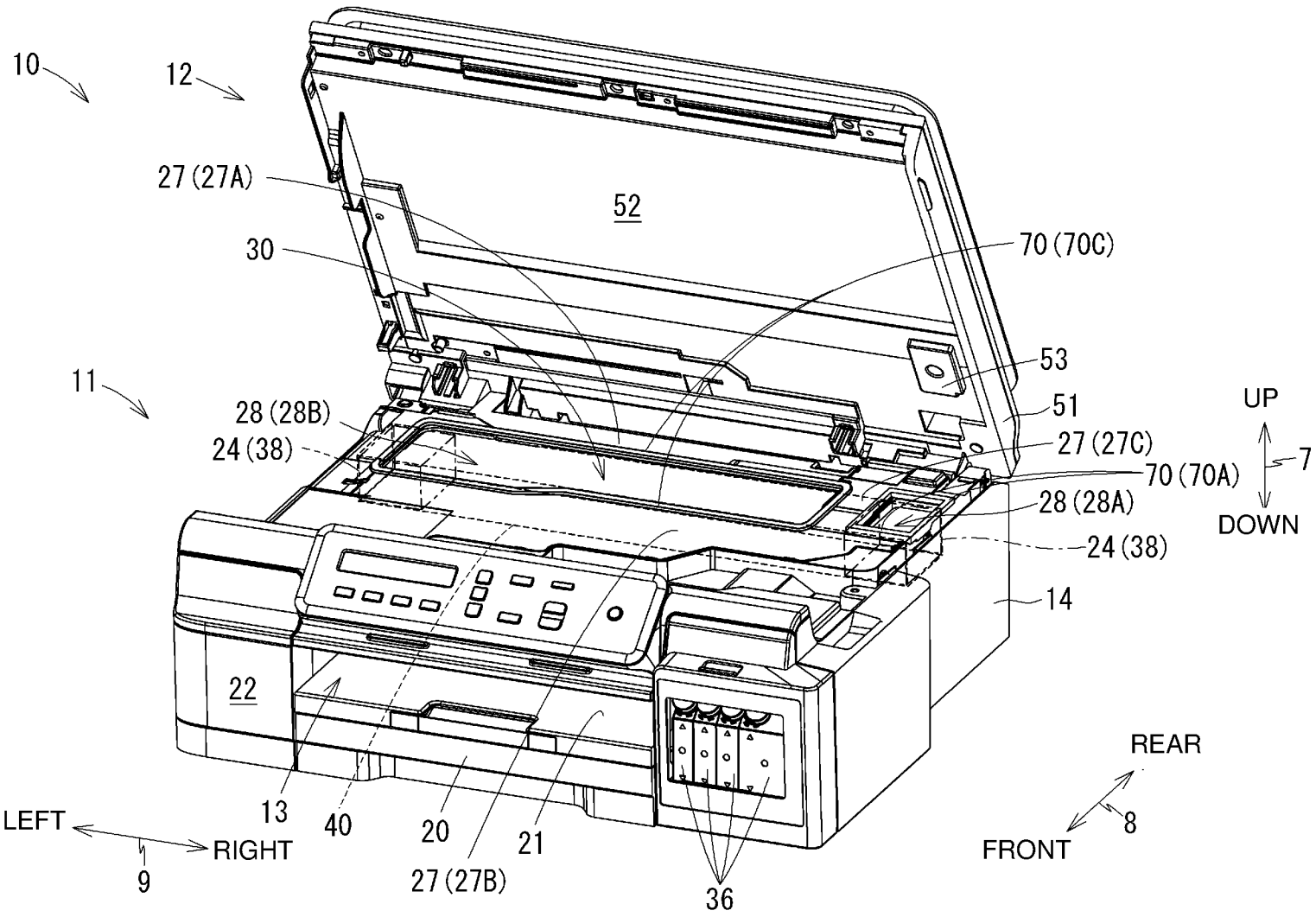
FIG. 8 is a perspective view of the multifunction device 10 in which the scanner casing 51 is positioned at the second position, and the dust-proof portions 70A and 70C are installed in the printer casing 14.

In the embodiment described above, the dust-proof portion 70 was installed in the scanner casing 51. However, the dust-proof portion 70 may have been installed in the printer casing 14 as depicted in FIG. 7. In FIG. 7, the dust-proof portion 70A is installed on the peripheral edge portion of the opening 28A. Moreover, the dust-proof portion 70B is installed near a front end of the opening 28B. Furthermore, the dust-proof portion 70C may have been installed on the peripheral edge portion of the opening 28B as depicted in FIG. 8. Although, it is not depicted in the diagram, the dust-proof portion 70D may have been installed along the frontward-rearward direction 8 at the right-end portion of the top plate 27 of the printer casing 14, and the dust-proof portion 70E may have been installed along the leftward-rightward direction 9 of a front-end portion of an upper end of the printer casing 14.

In the embodiment described above, the dust-proof portion 70A was arranged at the position corresponding to the peripheral edge portion of the opening 28A. Moreover, the dust-proof portion 70C was arranged at the position corresponding to the peripheral edge portion of the opening 28B. However, the dust-proof portion 70A may have been arranged throughout a range that can close the entire opening 28A, in the state of the scanner casing 51 positioned at the first position. Moreover, the dust-proof portion 70C may have been arranged throughout a range that can close the entire opening 28B, in the state of the scanner casing 51 positioned at the first position.

In this case, the opening 28 is closed by the dust-proof portions 70A and 70C, in the state of the scanner casing 51 positioned at the first position. However, by the dust-proof portion 70 being installed in the scanner casing 5, it is possible to expose the internal space 30 through the opening 28 when the scanner casing 51 is moved from the first position to the second position. Accordingly, when the paper 15 is jammed in the internal space 30, it is possible to take out the paper 15 through the opening 28. Whereas, when the scanner casing 51 is positioned at the first position, it is possible to suppress the entry of the dust etc. into the internal space 30.

Figure 9:
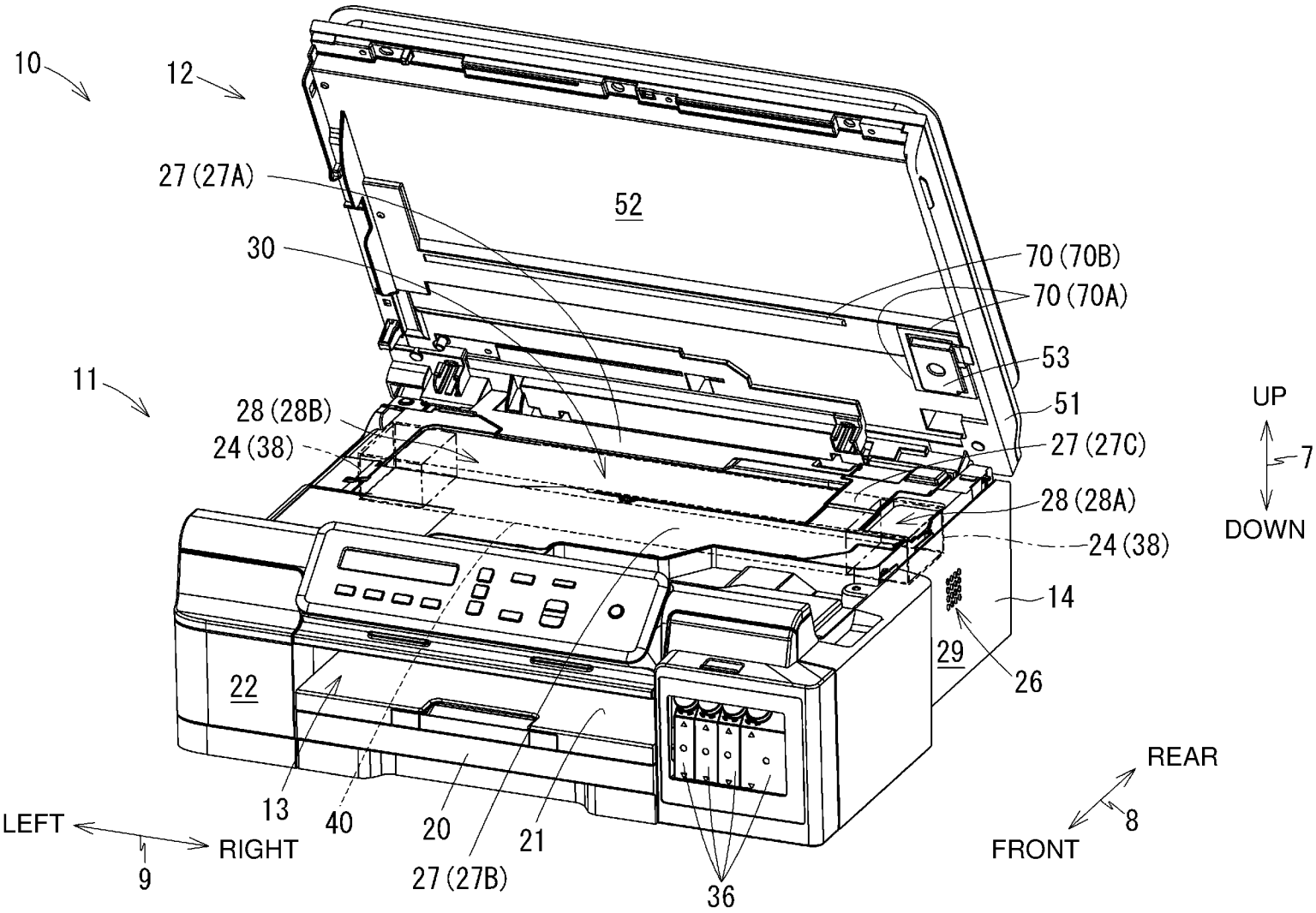
FIG. 9 is a perspective view of the multifunction device 10 in which the scanner casing 51 is positioned at the second position, and an opening 26 is formed in a side plate 29.

The dust-proof portion 70 may have been installed at a location other than the top plate 27 of the printer casing 14. For instance, as depicted in FIG. 9, in a case in which, an opening 26 for releasing heat is formed in a front plate 29 of the printer casing 14, the dust-proof portion 70 may have been installed to close the opening 26, on a surface directed toward the internal space 30 of the front plate 29.

Figure 10:
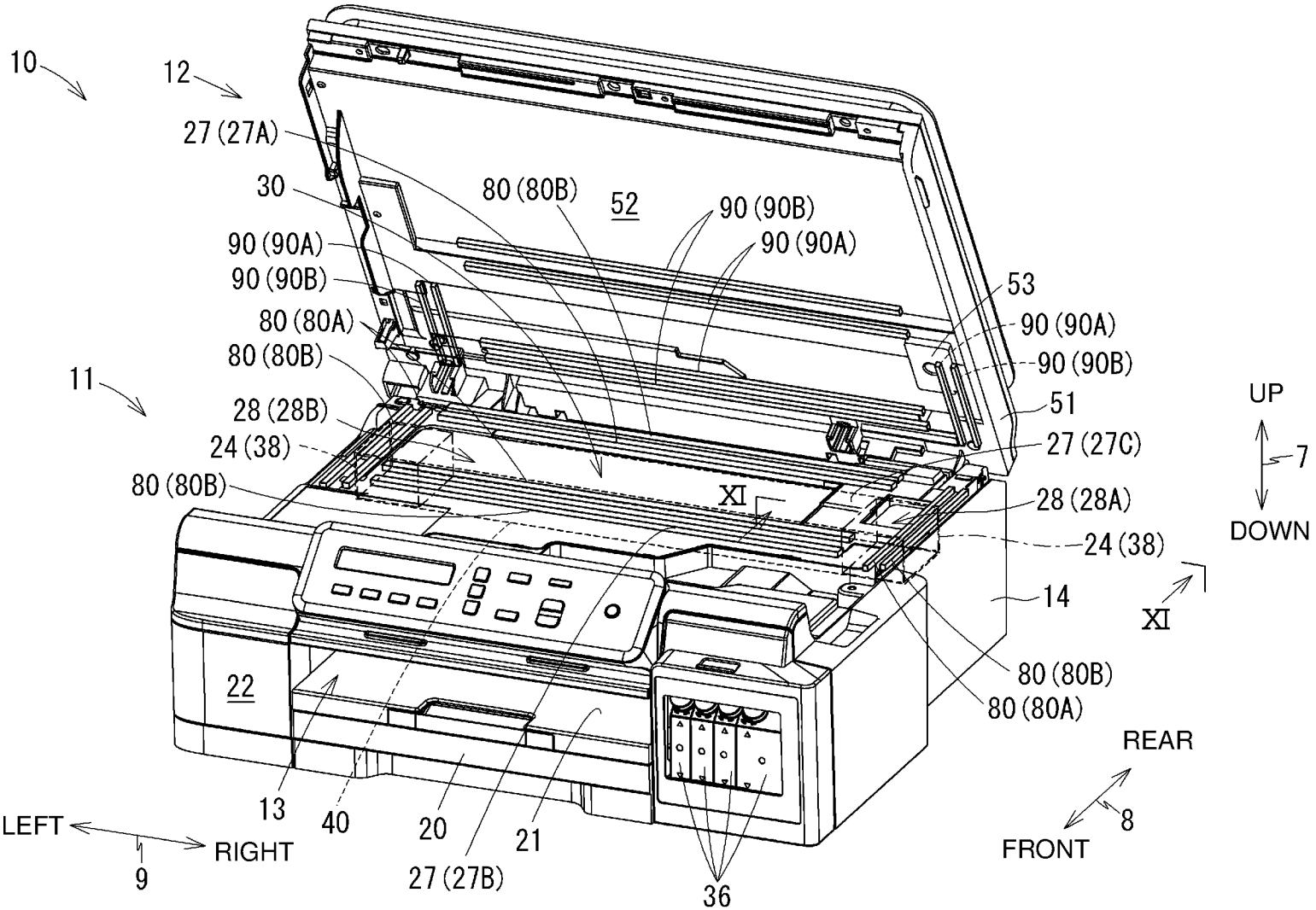
FIG. 10 is a perspective view of the multifunction device 10 in which the scanner casing 51 is positioned at the second position, and dust-proof portions 80 and 90 are installed in the printer casing 14.

The dust-proof portion may have been arranged in plurality at an interval in a cross direction intersecting an air flow from the exterior of the printer casing 14 to the internal space. For instance, as depicted in FIG. 10, a dust-proof portion 80 (80A and 80B) may have been arranged doubly at an interval in the cross direction, on the peripheral edge portion of the opening 28 of the top plate 27 of the printer casing 14. The dust-proof portion 80 may have been arranged triply or more than triply.

Moreover, in a case in which the dust-proof portion 80 has been arranged (refer to FIG. 10), a dust-proof portion 90 (90A and 90B) is arranged doubly at an interval in the cross direction, on a portion of the lower surface 52 of the scanner casing 51, corresponding to the peripheral edge portion of the opening 28. The dust-proof portion 90 may have been arranged in triply or more than triply.

Figure 11:
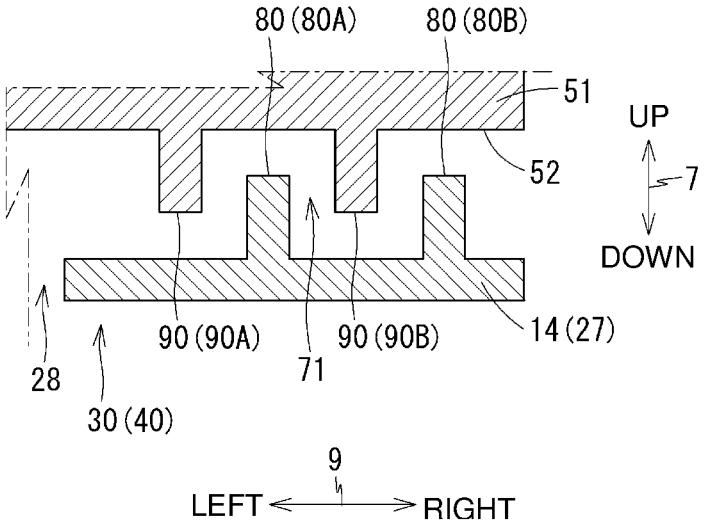
FIG. 11 is a XI-XI cross-sectional view in a case in which the scanner casing 51 in the state in FIG. 10 is positioned at the first position.
Figure 12:
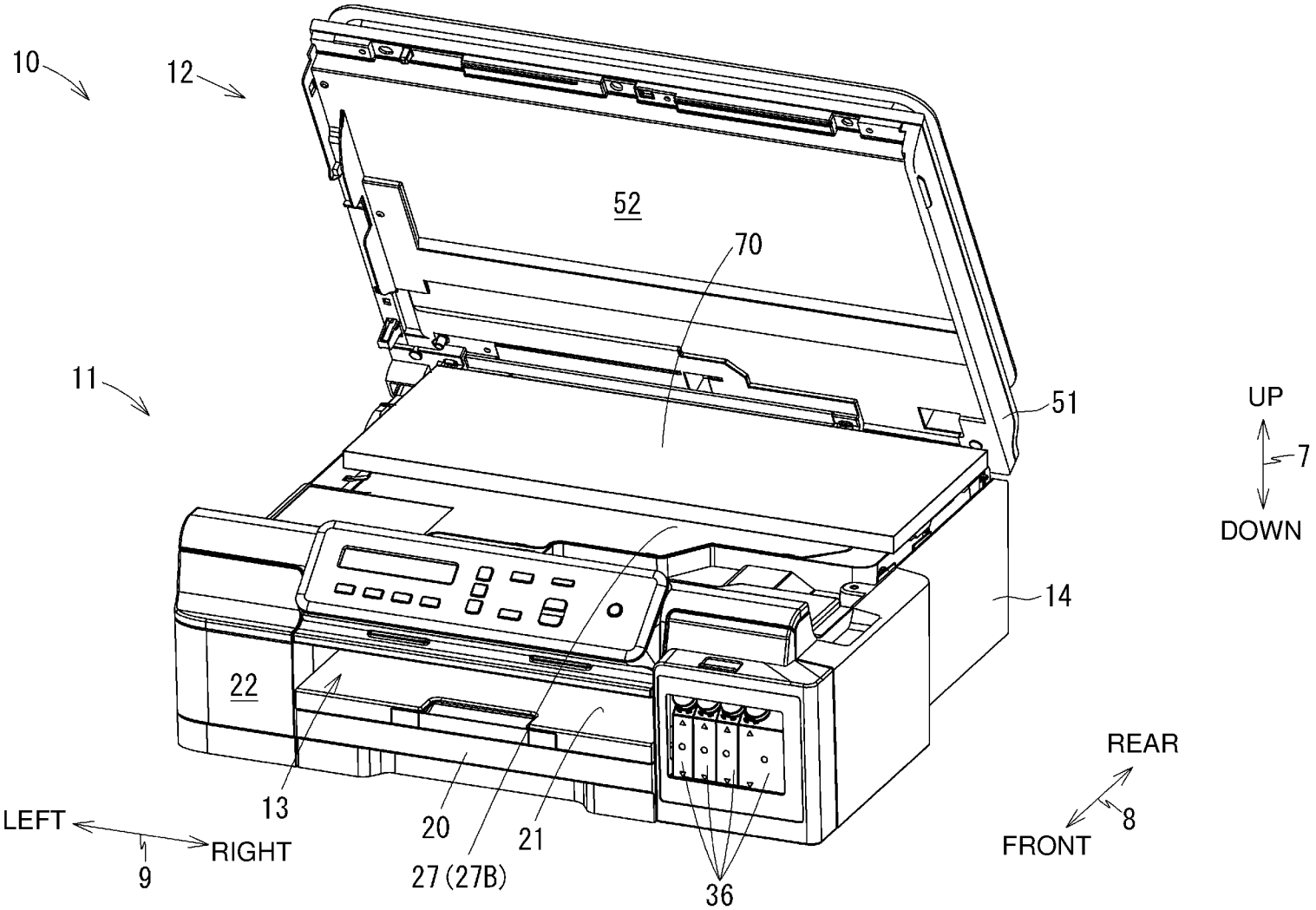
FIG. 12 is a perspective view of the multifunction device 10 in which the dust-proof portion 70 is pivotably arranged, and a state in which the scanner casing 51 is positioned at the second position, and the dust-proof portion 70 is in at an inclined state.
Figure 13:
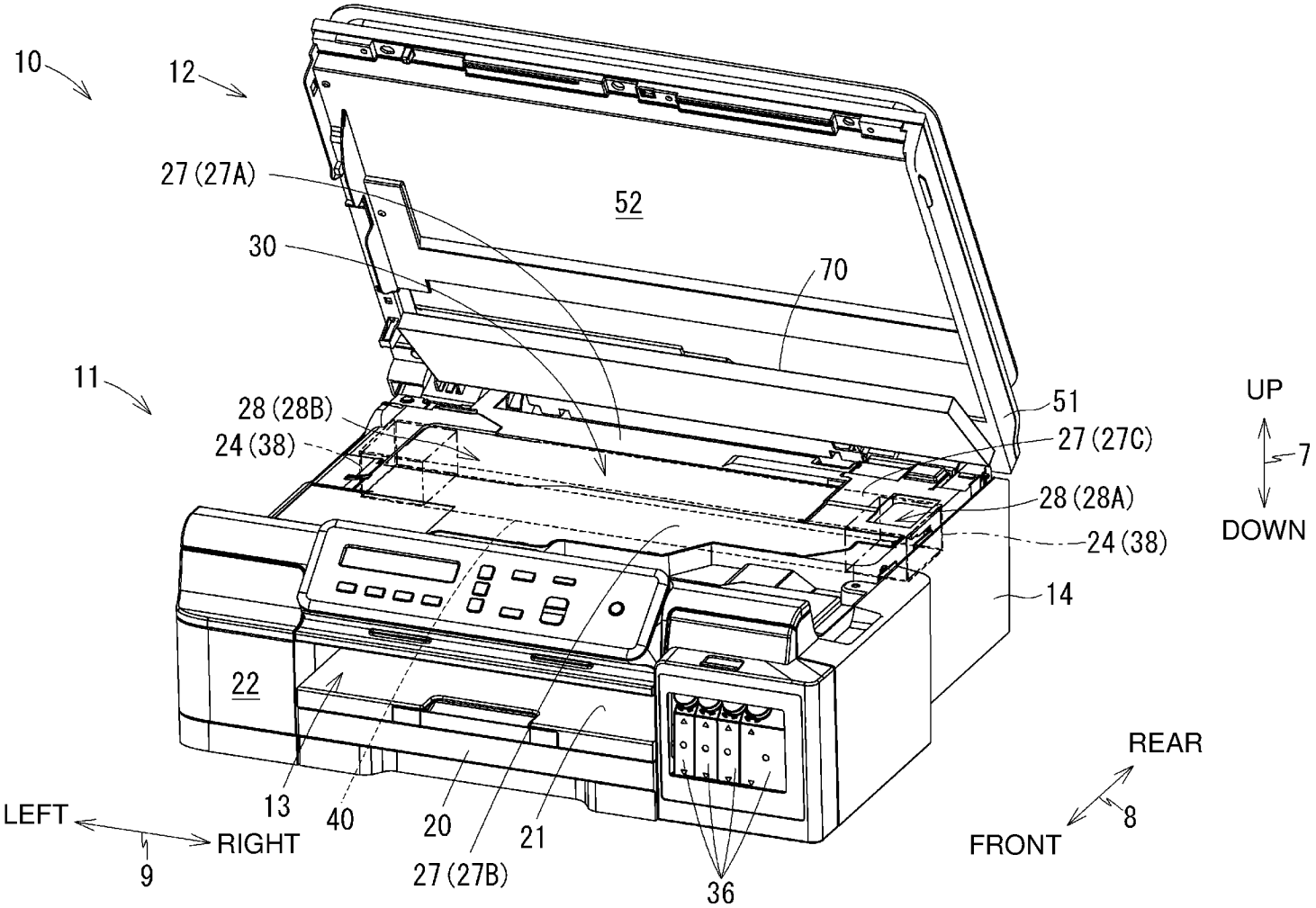
FIG. 13 is a perspective view of the multifunction device 10 in which the dust-proof portion 70 is pivotably arranged, and a state in which the scanner casing 51 is positioned at the second position and the dust-proof portion 70 is at a standing state.

As depicted in FIG. 11, the dust-proof portions 90A and 90B are arranged side-by-side alternately with the dust-proof portions 80A and 80B along the cross direction (leftward-rightward direction 9), in the state of the scanner casing 51 positioned at the first position. Accordingly, a channel 70 having a labyrinth shape, which makes the movable space 40 and the exterior of the printer casing 14 communicate, is formed by the dust-proof portions 80 and 90. In a case of arrangements depicted in FIG. 10 and FIG. 11, the dust-proof portions 80 and 90, without being restricted to a porous material such as foamed polyurethane, may have been formed of a resin such as polystyrene. Furthermore, the dust-proof portions 80 and 90 may have been formed integrally with the scanner casing 51 and the printer casing 14.

For the dust to enter into the internal space 30 from the exterior of the casing, it is necessary to pass through the channel 71 having the labyrinth shape formed in the dust-proof portions 80 and 90. However, as the pressure generated due to the movement of the carriage 38 weakens, a large amount of dust etc. stops at some midpoint in the channel 71. Accordingly, it is possible to suppress the entry of the dust etc. into the internal space 30 of the casing.

Moreover, a movement of air between the exterior of the casing and the internal space 30 is possible via the channel 71. Accordingly, it is possible to suppress heat released from a motor arranged in the internal space 30 from being accumulated in the internal space 30, and to suppress the temperature of the internal space 30 from rising.

In the embodiment described above, the dust-proof portion 70 was installed either in the scanner casing 51 or in the printer casing. However, the dust-proof portion 70 may have been installed in both the scanner casing 51 or the printer casing 14.

In the embodiment described above, although the dust-proof portion 70 was stuck to the lower surface of the scanner casing 51 or the top plate 27 of the printer casing 14, an arrangement is not restricted to sticking the dust-proof portion 70 to the scanner casing 51 or the printer casing 14. For instance, the dust-proof portion 70 may have been arranged pivotably similarly as the scanner casing 51. In an example depicted in FIG. 12 and FIG. 13, the dust-proof portion 70 is connected to the rear-end portion of the printer casing 14 by a hinge (not depicted in the diagram). The dust-proof portion 70 is pivotable to a inclined position (position depicted in FIG. 12) and a standing position (position depicted in FIG. 13), with a rear-end portion of the dust-proof portion 70 as a shaft. The dust-proof portion 70 in the inclined state covers the opening 28 from above (the upper side), while being inclined with respect to the printer casing 14. The dust-proof portion 70 in the standing position exposes the internal space 30 through the opening 28, while being erect with respect to the printer casing 14.

The abovementioned dust-proof portion 70 which is pivotable, may be pivoted independent of the scanner casing 51 or may be pivoted in conjunction with the scanner casing 51. In a case in which the dust-proof portion 70 is pivoted in conjunction with the scanner casing 51, the dust-proof portion 70 is pivoted from the inclined position to the standing position in conjunction with the pivoting of the scanner casing 51 from the first position to the second position.

In the embodiment described above, the multifunction device 10 includes two casings, which are, the printer casing 14 and the scanner casing 51. However, the multifunction device 10 may include only one casing. For instance, the multifunction device 10, without including the scanner casing 51, may include the printer casing 14. In this case, the dust-proof portion 70 is installed in the printer casing 14. More elaborately, the dust-proof portion 70 is installed to close a location where the internal space 30 of the printer casing 14 and the exterior of the printer casing 14 communicate.

What is claimed is:

1. An ink-jet recording apparatus, comprising:

a casing defining an internal space and including a top plate in which an opening is opened and which defines an upper end of the internal space;

a recording head arranged in the internal space, and configured to jet ink droplets;

a carriage which is movable in a scanning direction, and is arranged in the internal space, and on which the recording head is mounted; and a dust-proof portion arranged at least at a part of a peripheral edge portion of the opening, such that the dust-proof portion does not overlap with the opening at least at a center of the opening.

2. The ink-jet recording apparatus according to claim 1, wherein the carriage is movable between a first end position and a second end position in the scanning direction, and wherein the dust-proof portion is arranged between the first end position and the second end position in the scanning direction.

3. The ink-jet recording apparatus according to claim 1, wherein the dust-proof portion is elongated in the scanning direction.

4. The ink-jet recording apparatus according to claim 1, wherein the dust-proof portion is a porous material.

5. The ink-jet recording apparatus according to claim 1, wherein the casing includes a lower casing defining the internal space, and an upper casing arranged above the lower casing, and wherein the upper casing is movable to a first position at which the upper casing covers the lower casing from above, and a second position at which the upper casing is erect with respect to the lower casing, and exposes the internal space.

6. The ink-jet recording apparatus according to claim 5, wherein the lower casing includes the top plate defining the upper end of the internal space.

7. The ink-jet recording apparatus according to claim 6, wherein the dust-proof portion is installed in the upper casing.

8. The ink-jet recording apparatus according to claim 5, further comprising a scanner, wherein the upper casing is a casing of the scanner.

9. The ink-jet recording apparatus according to claim 1, wherein the dust-proof portion is arranged at an entire region of the peripheral edge portion.

* * * * *